US005188877A

United States Patent [19]

Magaro

[11] Patent Number: 5,188,877

[45] Date of Patent: Feb. 23, 1993

[54] THERMAL DEVICE

[76] Inventor: Steven B. Magaro, 606 Magaro Rd., Enola, Pa. 17025-1912

[21] Appl. No.: 666,061

[22] Filed: Mar. 7, 1991

[51] Int. Cl.[5] ..... F25D 3/08; B32B 3/06

[52] U.S. Cl. ..... 428/80; 428/100; 428/192; 428/194; 220/903; 150/154; 62/457.4; 62/457.8

[58] Field of Search ..... 428/72, 99, 100, 80, 428/192, 194; 220/903; 150/154; 62/457.4, 457.8

[56] References Cited

U.S. PATENT DOCUMENTS 4,399,668 8/1983 Williamson ..... 62/457.4

4,413,481 11/1983 Thomas ..... 62/457.4

*Primary Examiner*—Alexander S. Thomas

*Attorney, Agent, or Firm*—Allan B. Osborne

[57] ABSTRACT

A thermal device (10) for maintaining the temperature of the contents of a bottle has been disclosed. The device (10) includes a wrapper (12) having a pouch (18) for receiving an insulative member (14) and a strap (30) attached to spaced-apart locations along a bottom edge (20) to form a stop across one end of cylindrical shape of the wrapper (12) when rolled up. The wrapper (12) further includes mating gripping material (24,26) on both surfaces to hold the wrapper (12) in a cylindrical shape.

4 Claims, 2 Drawing Sheets

THERMAL DEVICE

FIELD OF THE INVENTION

The invention disclosed herein relates to a device which can be wrapped around a bottle and which will maintain the temperature of the contents of the bottle over a period of time.

BACKGROUND OF THE INVENTION

The best known device for maintaining the temperature of the contents of a bottle is the ice bucket. More commonly, a chilled bottle of wine is inserted into a bucket filled with ice cubes, placed alongside a table of diners and removed from the bucket to fill and replenish the glasses during the course of the dinner. Although the presence of a fanciful ice bucket adds a certain charm to a dining room, there are disadvantages. Unless the bottle is wiped each time it is removed from the bucket, water from the melting ice cubes will drip onto the table and utensils thereon to the annoyance of the diners. Further, after the bottle is removed, the water and ice cubes will fill the void so that the bottle must be worked back into the bucket. Sometimes the ice bucket must be positioned away from the table making it awkward for the diners to retrieve and replace the bottle. Another disadvantage is that the water and remaining ice cubes are wasted after serving their purpose, a waste unacceptable in places and times of drought. Accordingly, it is now proposed to provide a device which maintains the temperature of the contents of a bottle over a period of time without the disadvantages discussed above.

SUMMARY OF THE INVENTION

According to the present invention, a thermal device is provided which includes a wrapper of a cloth or other supple material, a pouch on one side of the wrapper and a strap attached to two spaced apart locations on one edge so that the strap will cross over an opening formed when the wrapper is rolled into a cylindrical from. Fastening means are provided to hold the wrapper in a cylindrical form. The device further includes a sheet of insulative material inserted in the pouch to provide a thermal barrier.

DESCRIPTION OF THE INVENTION

Figure 1:
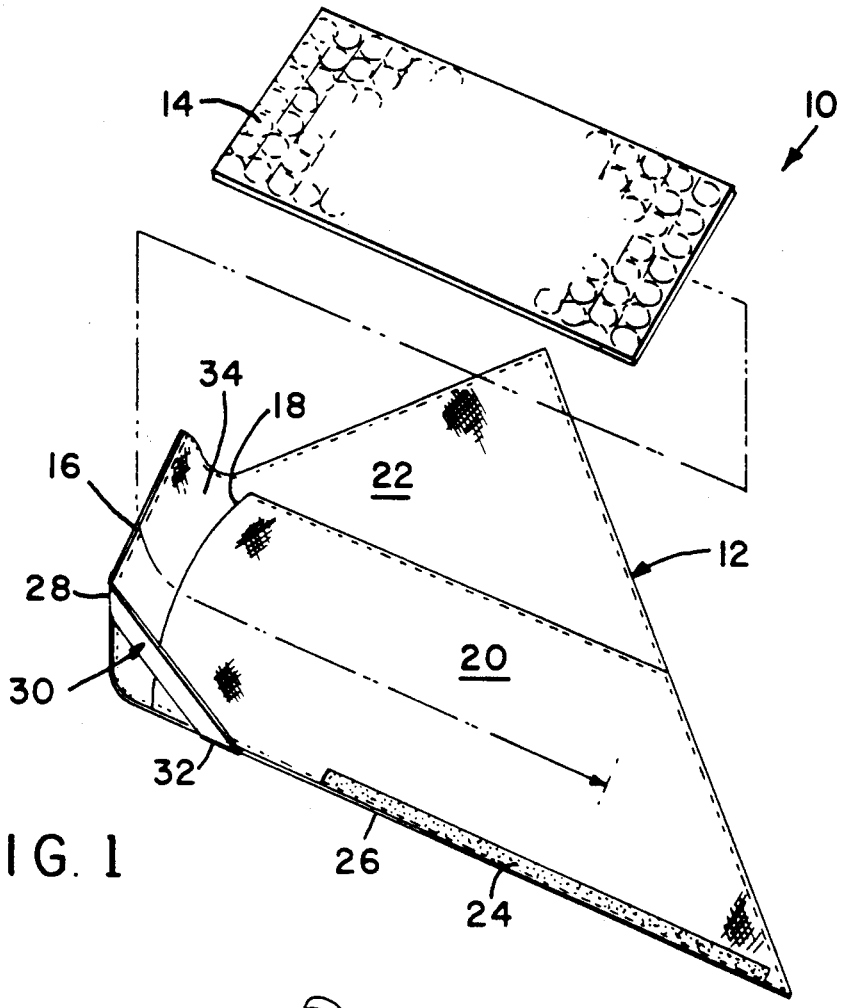
FIG. 1 is a view of a device of the present invention with the insulative member exploded therefrom.

With reference to Figure 1, thermal device 10 includes wrapper 12 and insulative member 14.

Wrapper 12 is preferably made from table linen, a supple material having a pleasing appearance and durability. The shape of wrapper 12 initially (not shown) is that of a triangle with end 16 truncated. Pouch 18 is formed by sewing or otherwise attaching a sheet 20 preferable of the same linen material, to inside surface 22. A strip 24 of a synthetic material which adheres to another like material when pressed together; e.g., VELCRO, is attached to inside surface 22 along bottom edge 26. Lastly, end 28 of strap 30 is attached to bottom edge 26 adjacent truncated end 16 and the other end 32 is attached to edge 26 further inwardly. The addition of strap 30 results in end 16 being brought up so that a pocket 34 is formed at that end of wrapper 12.

Figure 3:
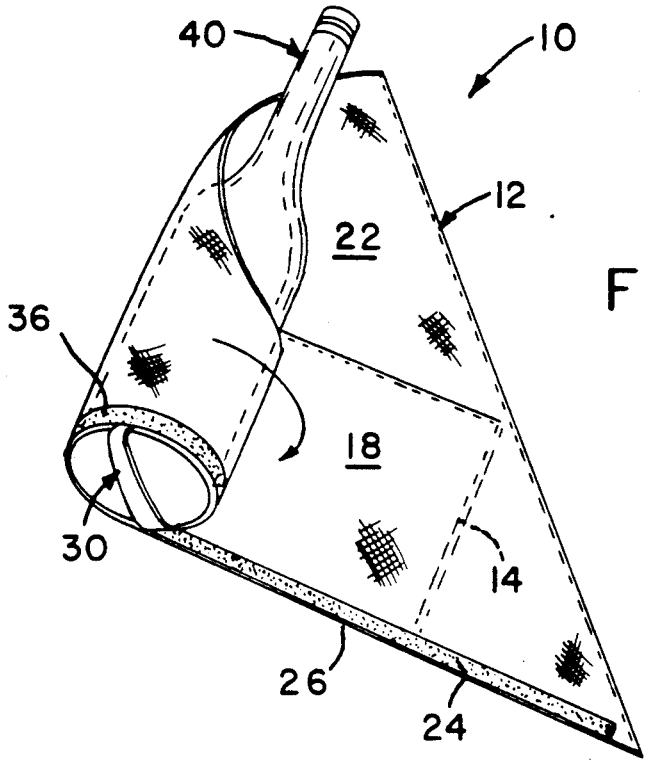
FIG. 3 is a view of the bottle being wrapped in the device.

A second strip 36 of synthetic material is attached to bottom edge 26 on outside surface 38 as shown in FIG. 3.

Insulative member 14 may be any material that has insulative properties. Preferably member 14 is a material sold by Reflectic, Inc. under the trademark REFLECTIC double bubble foil insulation. It has been found that this particular material is well suited for the purpose intended by the present invention.

Insulative member 14 is cut to fit snugly into pouch 18 so that it cannot slide out easily. However, as will be noted below, number 14 must be removable without damaging it.

Figure 2:
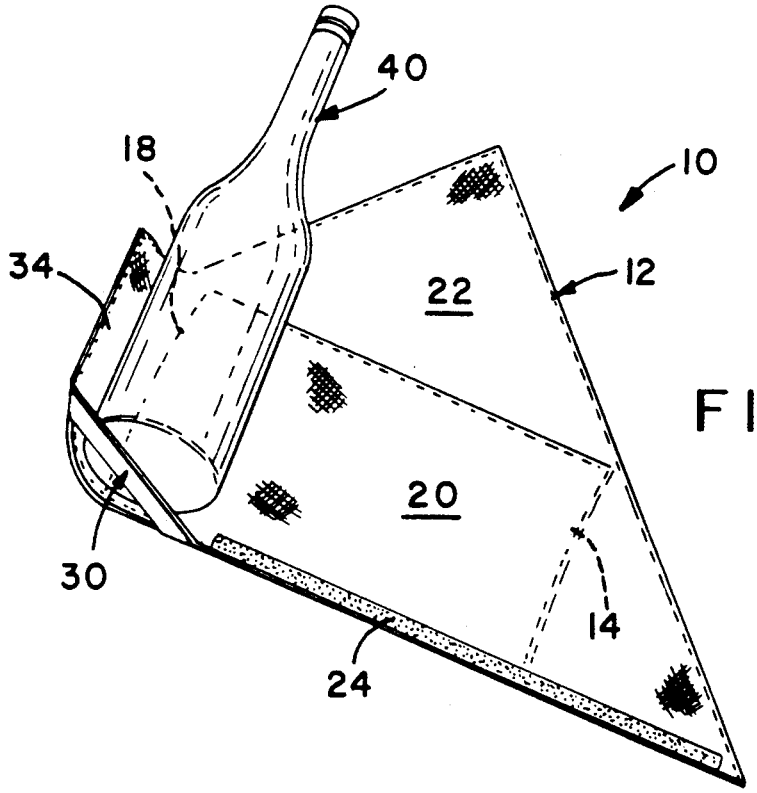
FIG. 2 is a view of the device in the open position and a bottle placed thereon.
Figure 4:
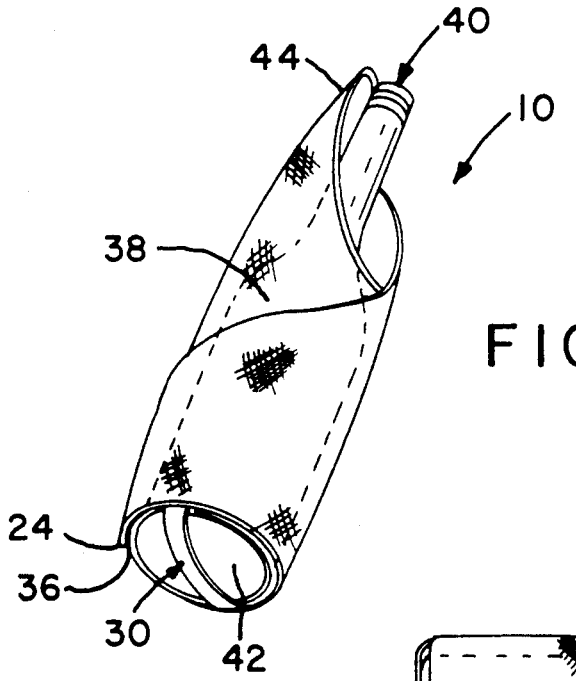
FIG. 4 is a view of the bottle wrapped in the device.
Figure 5:
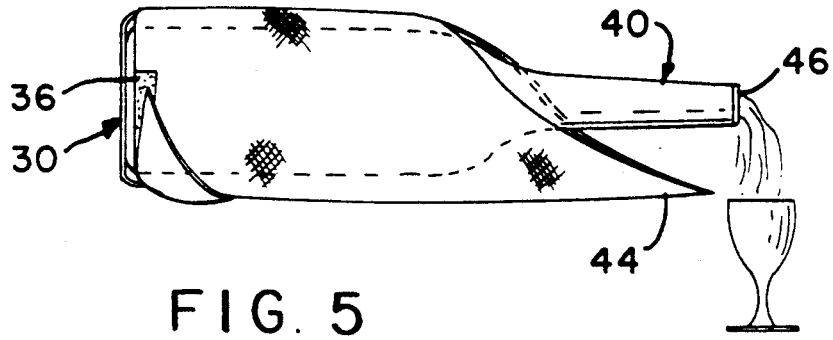
FIG. 5 is a view of the contents of the bottle in the device being poured into a glass.

Thermal device 10 shown in FIG. 2 includes insulative member 14 within pouch 18 and wine bottle 40 positioned in pocket 34. As shown in FIG. 3, bottle 40 is being wrapped and as shown in FIG. 4, is completely wrapped. As inside surface 22 meets outside surface 38, mating strips 24,36 engage to secure rolled up device 10 around bottle 40. Strap 30 crosses over base 42 of bottle 40 so it cannot slip thru device 10. Further, as shown in FIG. 4, apex 44 of device 10 provides both a decoration and functional features. For example, the owner's monogram may be embroidered thereon, particularly an important aspect where the owner is a restaurant. Secondly, and as indicated in FIG. 5, apex 44 will catch the wine dripping from mouth 46 of bottle 40.

When wrapper 12 becomes soiled, insulative member 14 is removed so that the wrapper can be launder.

Tests on a prototype showed that device 10 held the temperature loss of a bottle of wine chilled to forty degrees fahrenheit to five degrees over one hour in a room having an ambient temperature of about seventy two degrees fahrenheit.

As can be discerned from the foregoing description, an economical, easy to use device for maintaining the temperature of the contents of a bottle has been disclosed. The device includes a wrapper having a insulating member in a pouch and a strap attached to a bottom edge at two locations to form a pocket and to keep the bottle from slipping thru the device when rolled up therein.

I claim:

1. A thermal device for use in maintaining the temperature of the contents of a bottle over a period of time, said device comprising;

a triangular-shaped wrapper with one end truncated and being of a suitable, supple material having a pouch on an inside surface and a strap attached at spaced apart locations on one edge so that when said wrapper is rolled into a cylindrical shape, said strap crosses an opening at one end thereof;

holding means adapted to hold said wrapper in said cylindrical shape; and insulative means removably positioned in said pouch to prevent heat migration thru said wrapper.

2. The thermal device of claim 1 wherein another end of said strap is attached to said bottom edge adjacent said truncated end.

3. The thermal device of claim 2 wherein another end of said strap is attached at a spaced apart location on said bottom edge so that said truncated end and said strap cooperate to form a pocket.

4. The thermal device of claim 1 wherein an apex of said wrapper extends towards a mouth of a bottle which may be wrapped up in said device.

* * * * *